United States Patent [19]

Shemitz

[11] Patent Number: 4,796,169

[45] Date of Patent: Jan. 3, 1989

[54] LIGHTING FIXTURE WITH ROTATABLE GLARESHIELD

[75] Inventor: Sylvan R. Shemitz, Woodbridge, Conn.

[73] Assignee: Sylvan R. Shemitz Associates, Inc., West Haven, Conn.

[21] Appl. No.: 48,003

[22] Filed: May 8, 1987

[51] Int. Cl.[4] ..... F21V 17/02; F21V 21/02

[52] U.S. Cl. ..... 362/282; 362/287; 362/322; 362/432

[58] Field of Search ..... 362/277, 282, 283, 285, 362/287, 319, 322, 368, 370, 372, 418, 427, 432

[56] References Cited

U.S. PATENT DOCUMENTS

| | | | |
|---|---|---|---|
| Re. 13,158 | 10/1910 | Lockwood | 362/282 X |
| 1,123,938 | 1/1915 | Shaffer | 362/282 |
| 1,205,224 | 11/1916 | Koechlein | 362/283 |
| 1,411,074 | 3/1922 | Anderson | 362/368 |
| 1,524,963 | 2/1925 | Baker | 362/282 |
| 1,670,572 | 5/1928 | Hotchkin | 362/282 |
| 1,761,438 | 6/1930 | Douglas | 362/282 |
| 2,379,933 | 7/1945 | Schwarzmayr | 362/282 |
| 2,443,829 | 6/1948 | Lancry et al. | 362/282 |
| 3,124,309 | 3/1964 | Cantoni et al. | 362/282 |
| 3,511,985 | 5/1970 | Muscovitch | 362/282 |
| 3,752,408 | 8/1973 | Tixier | 362/282 X |
| 3,842,253 | 10/1974 | Walker et al. | 362/282 |
| 4,164,012 | 8/1979 | Gulliksen | 362/282 |
| 4,217,629 | 8/1980 | Russell | 362/147 |
| 4,235,523 | 11/1980 | Lapeyre | 350/276 |
| 4,261,029 | 4/1981 | Mousset | 362/283 |
| 4,316,652 | 2/1982 | Auer, Jr. et al. | 350/276 |
| 4,337,507 | 6/1982 | Lasker | 362/282 |
| 4,338,655 | 7/1982 | Gulliksen et al. | 362/281 |
| 4,443,834 | 4/1984 | Schafer et al. | 362/280 |
| 4,475,147 | 10/1984 | Kristofek | 362/148 |
| 4,623,956 | 11/1986 | Conti | 362/148 |

FOREIGN PATENT DOCUMENTS

| | | | |
|---|---|---|---|
| 709452 | 5/1931 | France | 362/282 |
| 1406687 | 6/1965 | France | 362/282 |
| 2485161 | 12/1981 | France | 362/282 |

*Primary Examiner*—Tony M. Argenbright
*Attorney, Agent, or Firm*—Mark D. Rowland

[57] ABSTRACT

A lighting fixture is provided which includes a rotatable lamp and reflector system which can be adjusted to direct its maximum candlepower at a desired vertical angle. The lighting fixture also includes a rotatable glareshield which can be adjusted to vary the height of the top of the shield to change the degree of shielding provided. The glareshield and the housing of the lighting fixture form an interchangeable unit which can be installed after wiring. The glareshield may be adapted to provide diffused or patterned backlighting. A removable supplementary baffle may be employed to prevent glare or reflected light from being viewed by a person beneath the lighting fixture, or to prevent undesired backlighting beneath the lighting fixture.

12 Claims, 7 Drawing Sheets

LIGHTING FIXTURE WITH ROTATABLE GLARESHIELD

BACKGROUND OF THE INVENTION

The present invention relates to a lighting fixture. More particularly, it relates to a lighting fixture which can be adjusted to direct the maximum candlepower of the lamp and reflector system of the lighting fixture at a desired vertical angle, and which includes a rotatable glareshield which can be adjusted to prevent glare from the lamp and reflector system of the lighting fixture from being viewed by persons present in the space illuminated by the lighting fixture.

A ceiling washer is a lighting fixture which is designed to uniformly illuminate the ceiling of a particular space by projecting light across the ceiling. The light is typically generated by a lamp, the output of which is intensified and directed by a system of reflectors. Several different designs have been employed to prevent glare from the lamp and reflector system from causing discomfort to those occupying the space lit by the ceiling washer. One such design involves concealing the lamp and reflector system in a buildin element, such as a cove located below the edges of the ceiling. Another approach has been to conceal the lamp and reflector system in a box which is mounted on a wall and provided with an open top. Yet another approach has been to provide a visor which protrudes from the bottom of the frame of the lamp and reflector system to shield the glare of the lamp and reflector system from the eyes of those occupying the illuminated space.

The degree of shielding necessary to prevent glare from being seen by those occupying the space depends on the geometry of the space illuminated by the lighting fixture and the height at which the lighting fixture is positioned. For example, where a lighting fixture is mounted in a room with a low ceiling, and therefore must be mounted at a low height, the sightline of persons occupying the room is such that the shielding provided must block the glare from the lamp and reflector system at a greater vertical angle than would be required in a room with a high ceiling where the fixture can be mounted at a greater height.

Likewise, the degree of shielding necessary depends on the size of the room to be illuminated, since the height at which glare is visible above the shield decreases as the horizontal distance between the viewer and the lighting fixture increases, assuming that at least some portion of the lamp and reflector system capable of creating glare is higher than the top of the shield.

Greater shielding is of course achieved by increasing the height of the shield; however, the greater the height of the shield is, the less effective the lighting fixture is as a ceiling washer. This is because a ceiling washer illuminates the greatest area of ceiling most uniformly when the maximum candlepower of the lamp and reflector system is directed far out across the ceiling, i.e., when the angle at which maximum candlepower is directed, as measured from a vertical line drawn upward from the lighting fixture, is large. The optimum value of the angle varies depending on the area and shape of the ceiling to be illuminated and the vertical distance between the lighting fixture and the ceiling. When light is projected at such a large angle, a high shield may block some of the light which otherwise would shine on the ceiling. Therefore, the shield should be made only as high as is required to prevent visible glare. Nonetheless, in some cases, the height of the shield required in a particular space to shield a lamp and reflector system which is designed to project its maximum candlepower at the "optimum" angle for the same space may be such that the maximum candlepower of light projected by the lamp and reflector system is actually blocked by the shield. In such circumstances, greater efficiency would be achieved by projecting the maximum candlepower of the lamp and reflector system in a more vertical direction so that more of the projected light reaches the ceiling.

In view of the foregoing, it would be desirable to be able to provide a lighting fixture which has an adjustable lamp and reflector system and an adjustable shield, both of which may be adjusted for use in various lighting arrangements to efficiently shield the glare created by the lamp and reflector system of the lighting fixture and to effectively light the surface desired.

It would also be desirable to be able to provide a means for easily mounting and removing the adjustable shield such that the shield and associated housing for the lighting fixture can be installed after the lighting fixture has been wired in place, and such that the shield and housing may be changed at a later time.

SUMMARY OF THE INVENTION

It is therefore an object of the present invention to provide an improved lighting fixture which can be adjusted to direct the maximum candlepower of the lamp and reflector system at a desired vertical angle and which includes a rotatable glareshield which can be adjusted to vary the height of the top of the shield to tailor the degree of shielding provided thereby to the requirements imposed by the geometry of the illuminated space and the position of the lighting fixture.

It is another object of the present invention to provide an improved lighting fixture having an adjustable shield and associated housing which can be installed after the lighting fixture is wired in place and which can be removed and replaced at a later time to effect a change in the style of the lighting fixture.

It is another object of the present invention to provide an improved lighting fixture which is capable of projecting light outward and upward across a ceiling or other surface and which is capable of projecting diffused light back toward the wall or other surface on which the lighting fixture is mounted.

It is anohher object of the present invention to provide an improved lighting fixture which is capable of projecting light outward and upward across a ceiling or other surface and which is capable of projecting light into specific solid angles in space to illuminate areas of the wall or other surface on which the lighting fixture as mounted above or below the lighting fixture as desired.

It is another object of the present invention to provide an improved lighting fixture having a removable means for preventing glare or reflected light from being viewed from beneath the lighting fixture and/or preventing glare or reflected light from being projected downward and backward toward the wall or other surface on which the lighting fixture is mounted.

It is another object of the present invention to provide an improved lighting fixture which can be employed in any one of the following configurations: (1) mounted on a wall or workstation partition to illuminate a ceiling; (2) mounted on a wall or workstation partition to illuminate a floor; (3) mounted on a wall or a workstation partition to illuminate a desk; or (4) mounted on a ceiling to illuminate a wall.

These and other objects of the present invention are accomplished by a lighting fixture which comprises a lamp and reflector system and a partially cylindrical shield pivotally supported in a removable enclosure. The lamp and reflector system is pivotally supported and can be rotated to vary the direction of the projected beam of light. The shield can be rotated to expose a portion of the surface of the shield to the beam of light projected by the lamp and reflector system to shield a desired portion of the beam of light. The shield may also be used to reflect light onto the surface on which the lighting fixture is mounted, and a supplementary baffle is provided to prevent light from emitting beneath and between the lamp and reflector system and the shield.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1A:
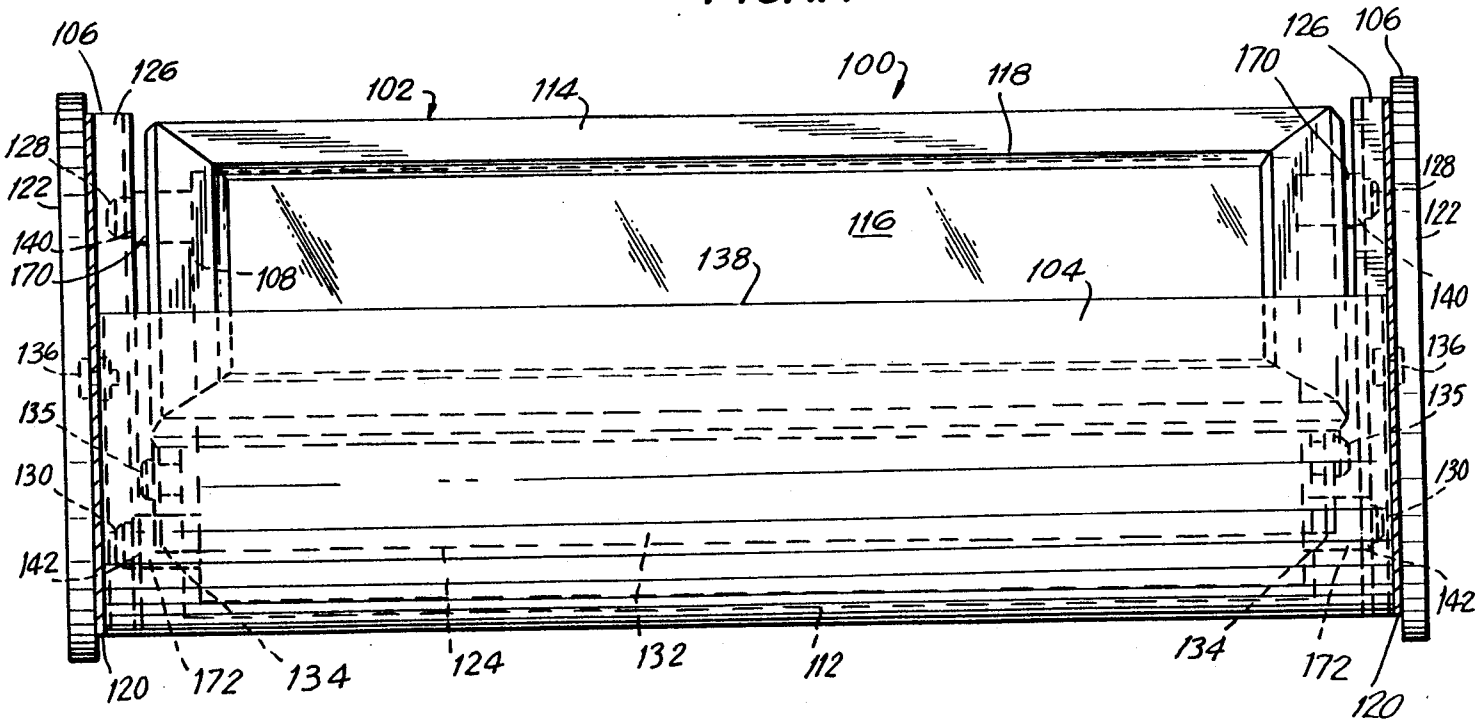
FIG. 1A is a front view of an embodiment of a lighting fixture according to the present invention.

Referring to FIG. 1A, lighting fixture 100 in accordance with the present invention is shown, comprising lamp and reflector system 102, glareshield 104, supporting structure 106, and mounting means 108 for mounting lighting fixture 100 to a surface. Lamp and reflector system 102 is enclosed by reflector frame 112 and glass door 114. Light is generated and focused by lamp and reflector system 102 and is projected through glass pane 116 of glass door 114. Glass pane 116 is held in place with respect to reflector frame 112 by door frame 118.

Conventional designs for lamp and reflector system 102 which are in accordance with the principles of the present invention may be employed. Alternatively, a lamp and reflector system may be used of the type described in U.S. Pat. No. 3,679,893, issued on July 25, 1972 to Sylvan R. Shemitz and Benjamin L. Stahlheber, the disclosure of which is incorporated herein by reference. Reference is made to the disclosure of that patent for purposes of illustration only, and is not to be considered a limitation on the scope of the present invention. For example, the lamp employed in a lighting fixture designed in accordance with the present invention may be of various types, which may include incandescent lamps, tungsten halogen lamps, metal halide lamps, high pressure sodium lamps and fluorescent lamps.

Figure 1B:
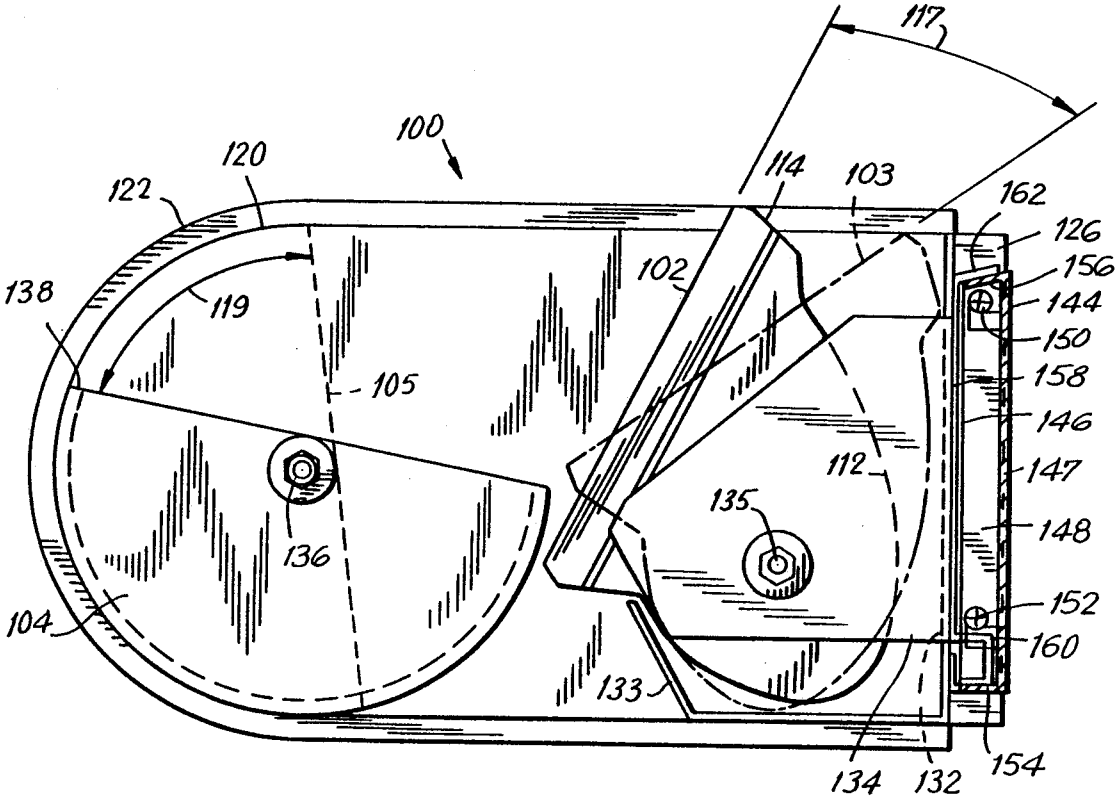
FIG. 1B is a side view of the lighting fixture according to FIG. 1A.
Figure 1C:
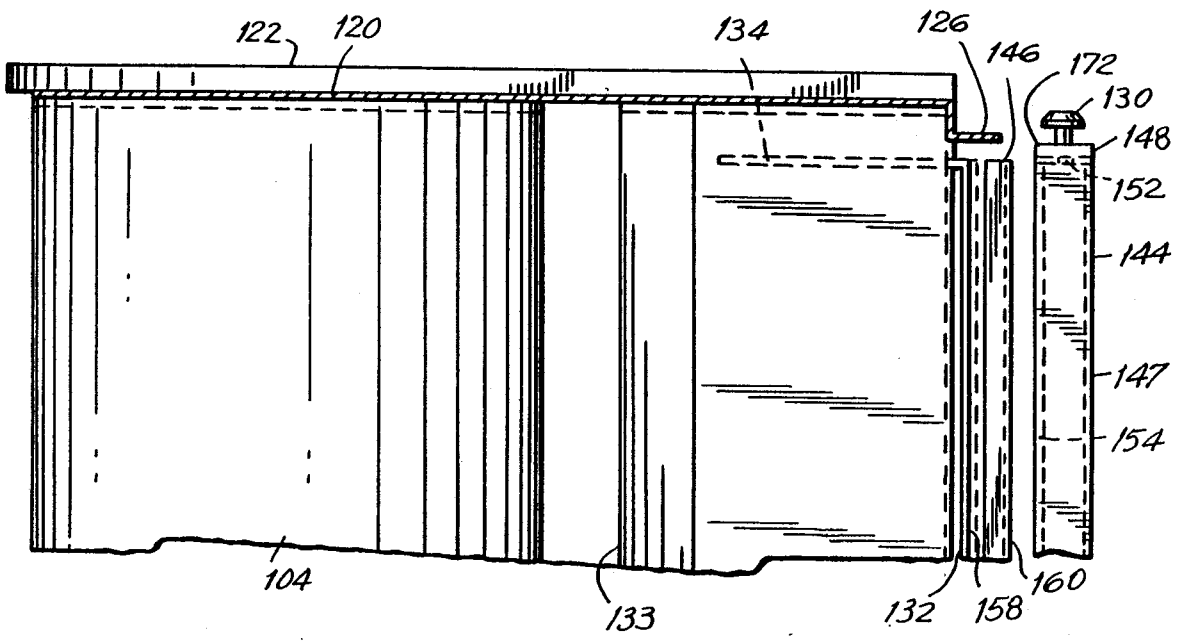
FIG. 1C is a partially exploded bottom plan view of the lighting fixture according to FIG. 1A.

Referring to FIGS. 1A–1C, supporting structure 106 comprises two side plates 120, two decorative end plates 122 and yoke 124. Side plates 120 are preferably made of steel or other material of suitable strength and extend along both sides of lighting fixture 100 to provide support for glareshield 104. Each side plate 120 has an L-shaped flange 126 which extends inwardly and rearwardly from the rear edge of the side plate. Each flange 126 has slots 140 and 142 for removably attaching the side plate to mounting means 108 by bolts 128 and 130. A decorative end plate 122 may be attached by screws or other conventional means to the outer surface of each side plate 120 to cover the plate and may be made of any material, and in any shape and color as desired by the designer.

Yoke 124 comprises rear portion 132, flange 133 (not shown in FIG. 1A) and two side portions 134. Rear portion 132 of yoke 124 extends substantially across the rear of lighting fixture 100 and is adapted to be attached to mounting means 108. Flange 133 extends forwardly from the bottom of rear portion 132 beneath lamp and reflector system 102. Side portions 134 of yoke 124 extend forwardly along the sides of, and provide support for, lamp and reflector system 102. Lamp and reflector system 102 is pivotally attached at each end to a side portion 134 of yoke 124 by bolt 135. The pivot points provided by bolts 135 permit the direction of the light projected through glass pane 116 to be adjusted upward or downward, depending on the desired angle at which the maximum candlepower of the system is to be directed. These pivot points preferably coincide with the center of the lamp in lamp and reflector system 102. The range of rotation of lamp and reflector system 102, shown in FIG. 1B by arrow 117 and shadowed lamp and reflector system 103, may vary in accordance with the choice of the designer.

Glareshield 104 is an open semi-cylindrical shell with enclosed ends. Preferably, the shell of glareshield 104 covers approximately 195 degrees of arc, and is pivotally mounted at each end to a side plate 120 by a bolt 136 such that the outer convex surface of glareshield 104 is directed substantially away from lamp and reflector system 102. The pivot points provided by bolts 136 permit glareshield 104 to be rotated such that the front edge 138 of glareshield 104 may be adjusted upward or downward to shield a desired portion of the light projected through glass pane 116, to thereby prevent glare from glass pane 116 from being visible to a person occupying the space illuminated by lighting fixture 100, as is shown more clearly by FIGS. 2A and 2B. The range of rotation of glareshield 104, shown in FIG. 1B by arrow 119 and shadowed glareshield 105, like that of lamp and reflector system 102, may vary in accordance with tee choice of the designer.

Mounting means 108 comprises bracket 144 and mounting plate 146. Bracket 144 and mounting plate 146 are made of steel or other material of suitable strength. Bracket 144 has a rear portion 147 which abuts the surface on which lighting fixture 100 is to be mounted and is adapted to be fixedly attached to the mounting surface. The means of attachment may be any conventional means which is capable of holding bracket 144 against the surface when bracket 144 is loaded with the weight of lighting fixture 100. Extending forwardly at a right angle from each side of rear portion 147 is a side element 148 having threaded holes 150 and 152 for receiving bolts 128 and 130. Extending forwardly at a right angle from the bottom of rear portion 147 is lower lip 154. Lower lip 154 is substantially L-shaped and extends across the length of rear portion 147. Extending forwardly and downwardly from the top of rear portion 147 is upper lip 156, which extends across the length of rear portion 147.

Mounting plate 146 has a front portion 15B which is adapted to be attached to rear portion 132 of yoke 124. Extending rearwardly at a right angle from the bottom of front portion 158 is lower member 160, which extends across the bottom of front portion 158. Lower member 160 is substantially U-shaped, and is designed to fit into the recess formed by lower lip 154 of bracket 144, as shown in FIG. 1B. Extending rearwardly and upwardly from the top of front portion 158 is upper member 162, which rests flush against the top of upper lip 156 when lower member 160 is inserted into lower lip 154 and the top of mounting plate 146 is pressed against bracket 144, as shown in FIG. 1B. Mounting plate 146 may have side portions which replace or fit inside of side elements 148 of bracket 144, and in which threaded holes are provided for receiving bolts 128 and 130.

Mounting plate 146 is attached to yoke 124, which pivotally supports lamp and reflector system 102. Glareshield 104, side plates 120 and decorative end plates 122 form an independent and interchangeable cover unit for lamp and reflector system 102. During installation of lighting fixture 100, bracket 144 is first attached to the surface on which lighting fixture 100 is to be mounted. The assembly of lamp and reflector system 102, yoke 124 and mounting plate 146 is then mounted on bracket 144 by inserting lower member 160 into lower lip 154. The resulting interlock of lower member 160 and lower lip 154 provides a hinge which facilitates the installation of lighting fixture 100 by allowing lamp and reflector system 102 to hang from bracket 144 while being wired by an electrician.

Once wiring is complete, the top of mounting plate 146 is pressed against bracket 144 such that upper member 162 rests on top of upper lip 156. Mounting plate 146 and bracket 144 may then be fastened together by any conventional means, such as by screws or bolts.

The interchangeable cover unit comprising glareshield 104, side plates 120 and decorative end plates 122 is installed by positioning the unit such that the ends of slots 140 and 142 are aligned with the shafts of bolts 128 and 130. The unit is then pressed against bracket 144 such that the shafts of bolts 128 and 130 slide along the lateral legs of slots 140 and 142 and come to rest in the vertical legs of slots 140 and 142. Bolts 128 and 130 are then tightened against flanges 126 to hold the cover unit in place. Bushings 170 and 172 may be employed to fill any gap between flanges 126 and bracket 144 to prevent distortion when bolts 128 and 130 are tightened. The offset between the outer surfaces of decorative end plates 122 and bracket 144 conceals bolts 128 and 130 from normal viewing angles. Bolts 128 nnd 130 may be replaced by conventional threaded studs adapted to receive nuts for holding the cover unit in place.

The interchangeable cover unit may be installed at any time. This makes the inventory of the manufacturer more flexible, and allows the interchangeable cover unit to be shipped and installed after the lamp and reflector system has been wired in place. It therefore reduces the manufacturer's inventory and shipping time, and can prevent jobsite damage to the unit caused by painters, movers, etc. It also permits a change in the style of the lighting fixture to be effected at a later time by simple replacement of the cover unit, without requiring that a new fixture be wired.

Figure 2A:
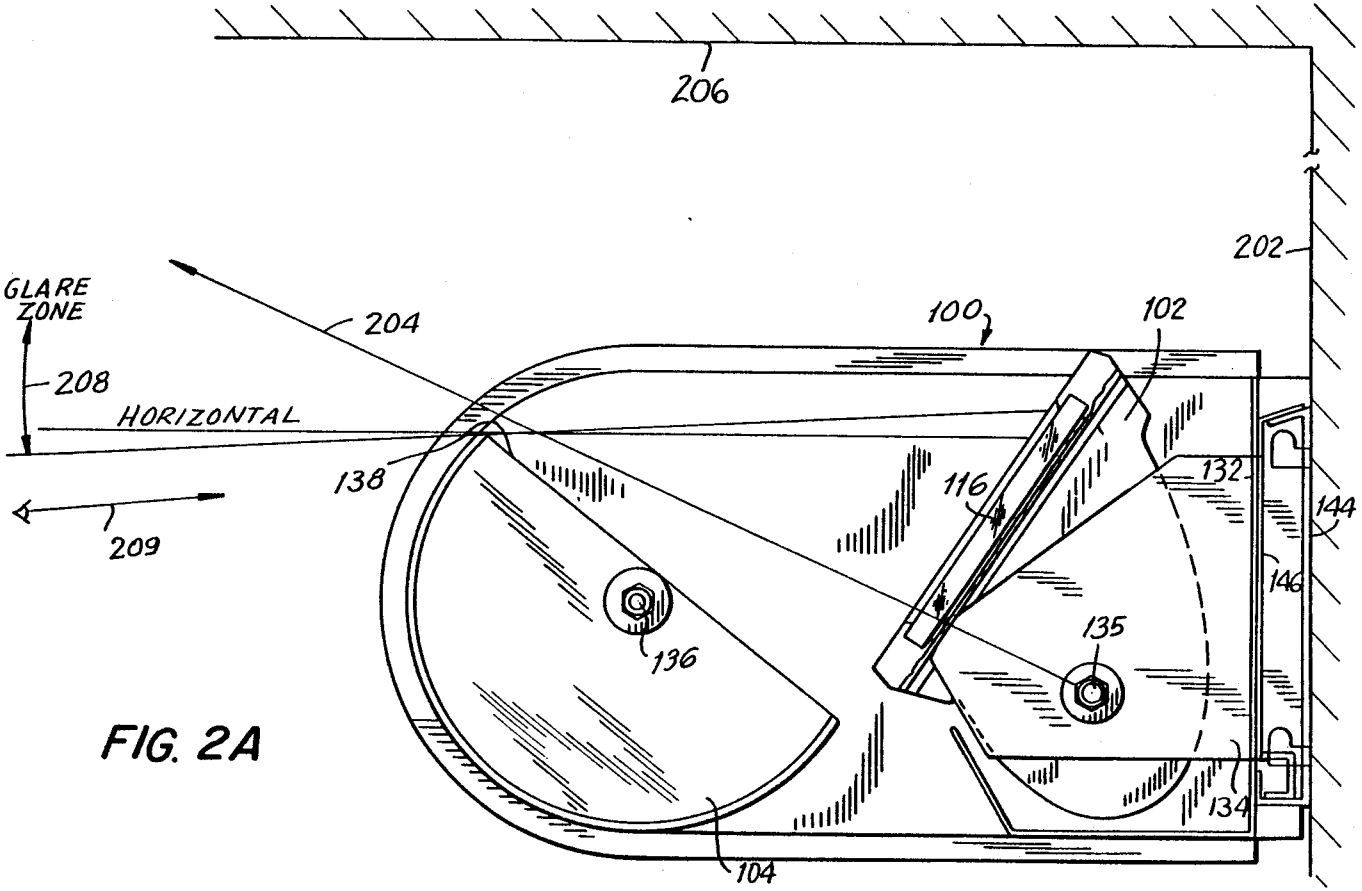
FIG. 2A is a side section view of an embodiment of a lighting fixture according to the present invention when the lamp and reflector system is adjusted to project light at a large angle from vertical and the glareshield is adjusted for low shielding.

FIG. 2A is a side view of lighting fixture 100 with lamp and reflector system 102 and glareshield 104 adjusted as shown in FIG. 1A. In this posture, lighting fixture 100 is best suited for use in circumstances where only a limited degree of shielding is necessary, e.g., where lighting fixture 100 is mounted high on the wall in a small room. Lamp and reflector system 102 is rotated downward and away from wall 202 to project its maximum candlepower, as shown by vector 204, far out across ceiling 206.

Since lighting fixture 100 shown in FIG. 2A is presumed to be mounted high on a wall in a room of short depth, the front edge 138 of glareshield 104 need not be positioned very high to prevent persons occupying the room from viewing glare from glass pane 116 of lamp and reflector system 102. The angle subtended by glare zone 208, which represents the area in which glare from glass pane 116 can be viewed, is narrowed only as much as necessary by rotating the front edge 138 of glareshield 104 to a low position as shown in FIG. 2A to keep glare zone 208 from intersecting the line of sight of persons occupying the room (represented in FIG. 2A by vector 209). In this manner, the maximum candlepower of lamp and reflector system 102 is permitted to shine without impedance far out onto ceiling 206 to wash ceiling 206 most efficiently and uniformly, and at the same time glare from lamp and reflector system 102 is shielded.

Figure 2B:
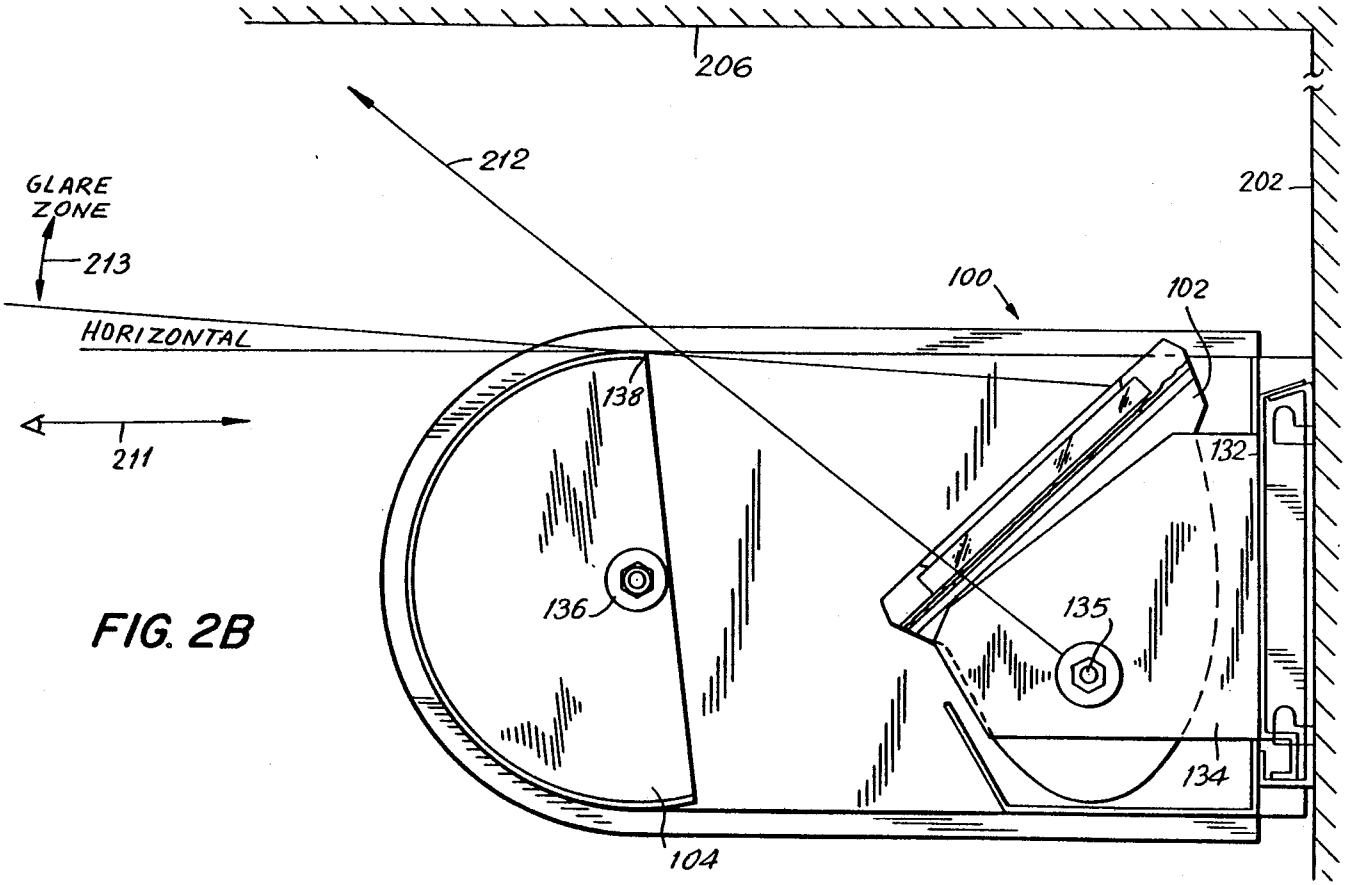
FIG. 2B is a side section view of the lighting fixture according to FIG. 2A with the lamp and reflector system adjusted to project light at a lesser angle from vertical and the glareshield adjusted for high shielding.

In less favorable circumstances which require a greater degree of shielding, e.g., where lighting fixture 100 is mounted low on a wall in a large room, the positions of lamp and reflector system 102 and glareshield 104 are adjusted as shown in FIG. 2B. Glareshield 104 is rotated to raise front edge 138 to the height necessary to prevent glare zone 213 from intersecting the line of sight of persons occupying the room illuminated by lighting fixture 100 (represented in FIG. 2B by vector 211). To minimize the amount of light which is lost by virtue of the raising of front edge 138 of glareshield 104, lamp and reflector system 102 is rotated backward toward wall 202 about the pivot points provided by bolts 135. In this manner, the maximum candlepower of lamp and reflector system 102 (represented in FIG. 2B by vector 212), is able to be projected unimpeded toward ceiling 206, and at the same time the glare from lamp and reflector system 102 is shielded.

The inner surfaces of lighting fixture 100 are preferably painted black to reduce reflection. Alternatively, backlighting of the surface on which lighting fixture 100 is mounted can be accomplished by painting the inner concave surface of the cylindrical shell of glareshield 104 with a matte white or other light color finish. When glareshield 104 is rotated to the position shown in FIG. 2B, and lamp and reflector system 102 is rotated slightly downward from the position shown in FIG. 2B, the inner concave surface of glareshield 104 is illuminated by spill light from lamp and projector system 102 of less intensity than the maximum candlepower of the projected light. Preferably, the intensity of the spill light illuminating glareshield 104 is 60 percent or less of that of the maximum candlepower. This illumination is reflected by the white finish 10 of the inner concave surface of glareshield 104, causing the inside of glareshield 104 to become bright white, and making glareshield 104 a secondary light source which delivers diffused light back to the surface on which lighting fixture 100 is mounted, both above and below lighting fixture 100.

Figure 3:
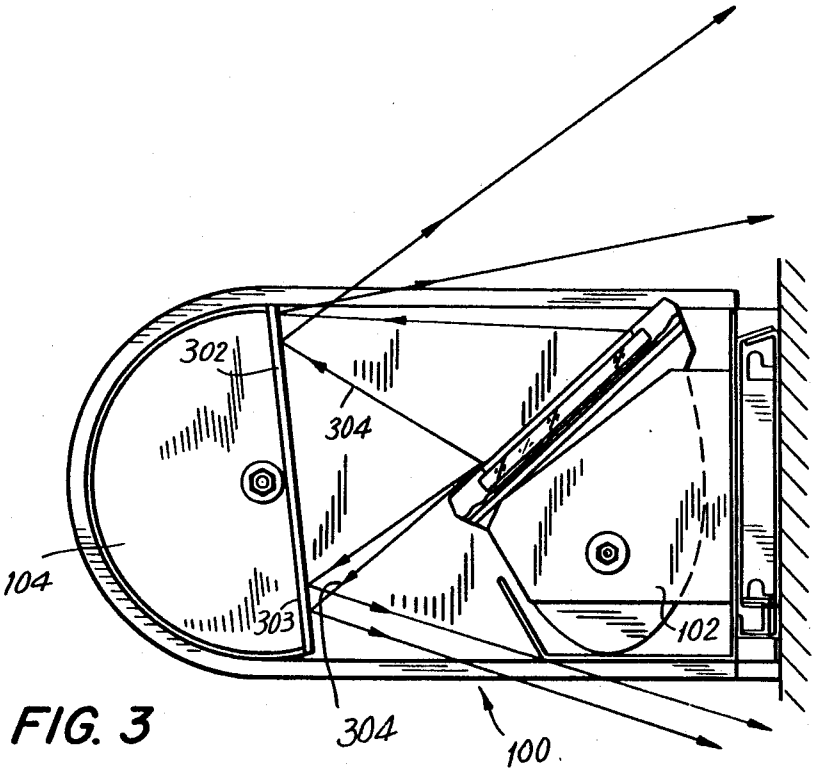
FIG. 3 is a side view of an embodiment of a lighting fixture according to the present invention showing a glareshield having a reflective element across its open back aperture.

If it is desired that the backlight be of a controlled distribution, rather than of the diffused distribution obtained by painting the inner concave surface of glareshield 104 matte white or another light color, reflective plate 302 may be provided as shown in FIG. 3 across open back aperture 303 of glareshield 104 to cause spill light 304 from lamp and reflector system 102 to be reflected in a desired pattern toward the surface on which lighting fixture 100 is mounted. Reflective plate 302 may be flat, concave or convex, and may be formed with smooth curves or flat facets to reflect spill light 304 into specific solid angles in space, depending on the choice of the designer. In this manner, the surface on which lighting fixture 100 is mounted may be illuminated with backlight above and/or below lighting fixture 100 as desired.

Figure 4:
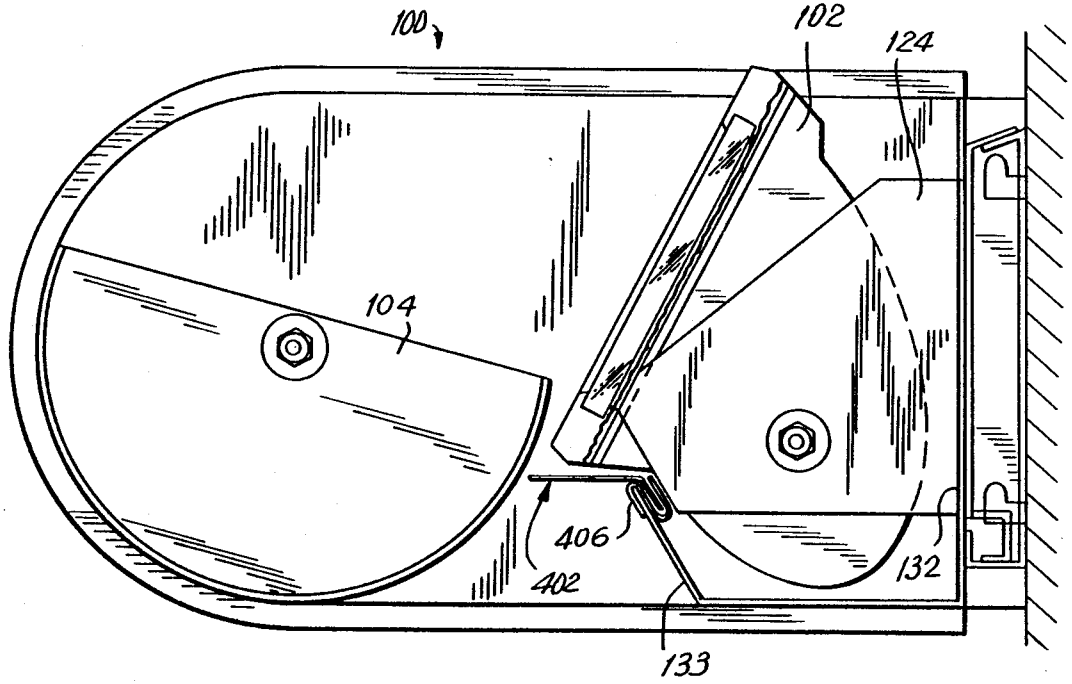
FIG. 4 is a side view of an embodiment of a lighting fixture according to the present invention with the removable supplementary baffle in place.

An additional feature of the present invention is shown by removable supplementary baffle 402 in FIG. 4. Baffle 402 is a strip of opaque material, preferably painted black to reduce reflection, which extends substantially across the width of lighting fixture 100 between lamp and reflector system 102 and glareshield 104. Baffle 402 is supported by flange 133, to which it is removably attached by spring clips 406, although other conventional means of removably mounting baffle 402 to flange 133 may be employed.

Baffle 402 prevents a person from seeing the glare or reflected light from lamp and reflector system 102 from a viewing position below lighting fixture 100. It is preferably installed when, as shown in FIG. 4, lamp and reflector system 102 is rotated downward away from the surface on which lighting fixture 100 is mounted and glareshield 104 is rotated to a relatively low position. Baffle 402 may also be employed to absorb or shield glare or light that might reflect off the outer convex surface of glareshield 104 and would otherwise be projected downward and backward toward the surface on which lighting fixture 100 is mounted.

While preferred embodiments of the invention have been set forth for purposes of the disclosure, modification of the disclosed embodiments may occur to those skilled in the art. For example, while the lighting fixture of the present invention has been disclosed as a ceiling washer, the lighting fixture, as a whole assembly, can be used as other than the ceiling washer heretofore described. The lighting fixture of the present invention can be inverted and mounted on a wall or workstation partition to illuminate a floor, or mounted on a wall or a workstation partition to light a desk. The lighting fixture may also be mounted on a ceiling to wash a wall with light.

Thus, a lighting fixture which includes a rotatable lamp and reflector system which can be adjusted to vary the angle at which its maximum candlepower is projected, and which includes a rotatable glareshield which can be adjusted to prevent glare from the lamp and reflector system of the lighting fixture from being viewed by persons occupying the space illuminated by the lighting fixture, has been disclosed. The lighting fixture of the present invention can readily be employed to illuminate a ceiling, wall, floor or desk, and may further include means for providing and controlling backlighting of the surface on which the lighting fixture is mounted. One skilled in the art will appreciate that the present invention can ee practiced by other than the described embodiments, and the present invention is limited only by the claims which follow

What is claimed is:

1. In a lighting fixture which includes means for mounting the lighting fixture on a surface, and which includes a lamp and reflector system for projecting a beam of light through an aperture in the lamp and reflector system, said lighting fixture further including means connected to opposing first and second ends of the lamp and reflector system for pivotally supporting the lamp and reflector system such that the lamp and reflector system may be rotated about a first axis to vary the direction of projection of the beam of light which is projected through the aperture of the lamp and reflector system, means for adjustably shielding a portion of the beam of light which is projected through the aperture in the lamp and reflector system, the adjustable shielding means comprising:

a curved shield, partially cylindrical in shape, having opposing first and second ends, an inner concave surface, and a second axis displaced from the first axis, at least a portion of the inner concave surface being exposed to the beam of light projected through the aperture in the lamp and reflector system;

means, connected to the first and second ends of the curved shield, for pivotally supporting the curved shield such that the curved shield may be rotated about the second axis to vary the portion of the inner concave surface which is exposed to the beam of light projected through the aperture in the lamp and reflector system, whereby a desired portion of the beam of light projected by the lamp and reflector system is shielded by the exposed portion of the inner concave surface of the curved shield.

2. The lighting fixture of claim 1, wherein the inner concave surface of the curved shield has a matte white or light color finish and may be rotated such that a variable portion of the beam of light projected through the aperture in the lamp and reflector system is intercepted and reflected toward and strikes the surface on which the lighting fixture is mounted, and wherein the portion of the beam of light which is intercepted and reflected can be further varied by varying the rotational orientation of the lamp and reflector system.

3. The lighting fixture of claim 1, wherein the curved shield further comprises a formed reflector covering at least a portion of the inner concave surface of the curved shield, and wherein the curved shield may be rotated such that a variable portion of the beam of light projected through the aperture of the lamp and reflector system is intercepted and reflected by the formed reflector toward and strikes the surface on which the lighting fixture is mounted, and wherein the portion of the beam of light which is intercepted and reflected can be further varied by varying the rotational orientation of the lamp and reflector system.

4. The lighting fixture of claim 1 further comprising:

a supplementary baffle; and means for supporting the supplementary baffle between the lamp and reflector system and the curved shield, and beneath the aperture of the lamp and reflector system and the inner concave surface of the curved shield, such that the supplementary baffle substantially shields any light which otherwise would leak beneath the aperture of the lamp and reflector system and the inner concave surface of the curved shield.

5. A lighting fixture, comprising a lamp and reflector system for projecting a beam of light through an aperture in the lamp and reflector system;

means, attached to the lamp and reflector system, for removably mounting the lamp and reflector system on a mounting surface;

an enclosure for the lamp and reflector system having an outer decorative surface which substantially surrounds the front and sides of the lamp and reflector system, and having an opening positioned substantially above the top of the lamp and reflector system to permit the beam of light to be projected outside of the enclosure, and further having a rear portion which partially surrounds the mounting means and which abuts the mounting surface, the rear portion including two or more slots extending forwardly from the mounting surface; and means for supporting the enclosure, wherein the supporting means is associated with the mounting means and is received by the two or more slots in the rear portion of the enclosure when the enclosure is positioned around the lamp and reflector system and the rear portion of the enclosure abuts the mounting surface, and whereby the enclosure may be installed after the lamp and reflector system has been mounted on the mounting surface and may be removed and replaced without dismounting the lamp and reflector system from the mounting surface.

6. The lighting fixture of claim 5, wherein the mounting means comprises a bracket adapted to be secured to the mounting surface and having upper and lower lips;

a mounting plate adapted to be secured to the lamp and reflector system and to be removably fastened to the bracket, and having lower and upper members, the lower member being adapted to be received by the lower lip to act as a hinge between the mounting plate and the bracket, and the upper member being adapted to rest substantially flush against the upper lip when the mounting plate is fastened to the bracket.

7. The lighting fixture of claim 5, wherein the enclosure includes an adjustable shielding means comprising:

a curved shield, partially cylindrical in shape, having opposing first and second ends and having an inner concave surface, at least a portion of the inner concave surface being exposed to the beam of light projected through the aperture in the lamp and reflector system;

means, connected to the first and second ends of the curved shield, for pivotally supporting the curved shield such that the curved shield may be rotated about the pivotal support means to increase or decrease the portion of the inner concave surface which is exposed to the beam of light projected through the aperture of the lamp and reflector system, whereby a desired portion of the beam of light projected by the lamp and reflector system is shielded by the exposed portion of the inner concave surface of the curved shield.

8. The lighting fixture of claim 6, wherein either the mounting plate or the bracket has opposing side portions which extend substantially perpendicular to the mounting surface and in which are provided threaded holes; and wherein the supporting means comprises threaded bolts adapted to be received by the threaded holes, the shafts of which bolts are adapted to be received by the two or more slots in the rear portion of the enclosure.

9. The lighting fixture of claim 5, wherein at least a portion of each of the two or more slots in the rear portion of the enclosure extends substantially parallel to the mounting surface.

10. In a lighting fixture which includes means for mounting the lighting fixture on a surface, and which includes a lamp and reflector system adapted to house at least one lamp bulb for projecting a beam of light through an aperture in the lamp and reflector system, said lighting fixture further including means connected to the lamp and reflector system for pivotally supporting the lamp and reflector system such that the lamp and reflector system may be rotated about a first axis to vary the direction of projection of the beam of light which is projected through the aperture of the lamp and reflector system, means for adjustably shielding a portion of the beam of light which is projected through the aperture in the lamp and reflector system, the adjustable shielding means comprising:

a shield having an inner surface at least a portion of which is exposed to the beam of light projected through the aperture in the lamp and reflector system;

means connected to the shield for pivotally supporting the shield such that the shield may be rotated about a second axis displaced from the first axis to vary the portion of the inner surface which is exposed to the beam of light projected through the aperture in the lamp and reflector system, whereby a desired portion of the beam of light projected by the lamp and reflector system is shielded by the exposed portion of the inner surface of the shield.

11. The lighting fixture of claim 10, wherein the inner surface of the shield is substantially flat.

12. The lighting fixture of claim 11, wherein the inner surface of the shield is at least partially reflective.

* * * * *

UNITED STATES PATENT AND TRADEMARK OFFICE

CERTIFICATE OF CORRECTION

PATENT NO. : 4,796,169

DATED : January 3, 1989

INVENTOR(S) : Sylvan R. Shemitz

It is certified that error appears in the above-identified patent and that said Letters Patent is hereby corrected as shown below:

Column 1, line 24, "buildin" should be -- building --;

Column 2, line 49, "anohher" should be -- another --;

Column 4, line 59, "tee" should be -- the --;

Column 5, line 12, "15B" should be -- 158 --;

Column 8, line 4, "ee" should be -- be --

Signed and Sealed this

Twenty-fifth Day of February, 1992

*Attest:*

HARRY F. MANBECK, JR.

*Attesting Officer*

*Commissioner of Patents and Trademarks*